US008847867B2

(12) United States Patent
Zhang

(10) Patent No.: US 8,847,867 B2
(45) Date of Patent: Sep. 30, 2014

(54) DATA DRIVING CIRCUIT AND DATA DRIVING METHOD FOR LIQUID CRYSTAL DISPLAY

(75) Inventor: Liang Zhang, Beijing (CN)

(73) Assignee: Beijing Boe Optoelectronics Technology Co., Ltd., Beijing (CN)

( * ) Notice: Subject to any disclaimer, the term of this patent is extended or adjusted under 35 U.S.C. 154(b) by 852 days.

(21) Appl. No.: 12/731,314

(22) Filed: Mar. 25, 2010

(65) Prior Publication Data

US 2010/0245336 A1 Sep. 30, 2010

(30) Foreign Application Priority Data

Mar. 27, 2009 (CN) ..... 2009 1 0081012

(51) Int. Cl.
*G09G 3/36* (2006.01)

(52) U.S. Cl.
CPC ..... *G09G 3/3611* (2013.01); *G09G 2310/027* (2013.01); *G09G 3/3696* (2013.01); *G09G 3/3688* (2013.01); *G09G 2330/021* (2013.01); *G09G 3/3614* (2013.01)
USPC ..... 345/96

(58) Field of Classification Search
USPC ..... 345/96
See application file for complete search history.

(56) References Cited

U.S. PATENT DOCUMENTS 5,250,937 A * 10/1993 Kikuo et al. ..... 345/89
5,436,635 A * 7/1995 Takahara et al. ..... 345/96
5,640,174 A * 6/1997 Kamei et al. ..... 345/96
5,712,652 A 1/1998 Sato et al.
5,774,099 A * 6/1998 Iwasaki et al. ..... 345/87
5,847,688 A * 12/1998 Ohi et al. ..... 345/98
5,956,007 A * 9/1999 Ito et al. ..... 345/89
6,157,358 A * 12/2000 Nakajima et al. ..... 345/96
6,249,270 B1 * 6/2001 Ito ..... 345/98
6,380,919 B1 * 4/2002 Koyama et al. ..... 345/96
2002/0060655 A1 * 5/2002 Moon ..... 345/87
2002/0067330 A1 * 6/2002 Okuzono ..... 345/96
2002/0154086 A1 * 10/2002 Furuhashi et al. ..... 345/100
2006/0187176 A1 8/2006 Yang
2006/0279514 A1 * 12/2006 Yokota et al. ..... 345/100
2007/0069214 A1 * 3/2007 Lee ..... 257/72
2007/0097052 A1 5/2007 Sasaki (Continued)

FOREIGN PATENT DOCUMENTS

CN 1955824 A 5/2007
CN 101350172 A 1/2009

(Continued)

OTHER PUBLICATIONS

KIPO Notice of Allowance dated Jul. 28, 2011; Appln. No. 10-2010-0027527.

(Continued)

*Primary Examiner* — Adam J Snyder
(74) *Attorney, Agent, or Firm* — Ladas & Parry LLP

(57) ABSTRACT

A driving circuit and driving method for liquid crystal display is disclosed. The driving circuit comprises a time sequence controller, a first data driving chip and a second data driving chip connected to the time sequence controller, and a reference voltage buffer connected to the first data driving chip and the second data driving chip respectively. The two data driving chips output a pixel voltage signal of positive polarity and a pixel voltage signal of negative polarity to a liquid crystal display panel respectively.

9 Claims, 5 Drawing Sheets

(56) References Cited

U.S. PATENT DOCUMENTS

| | | | | |
|---|---|---|---|---|
| 2007/0115234 | A1 | 5/2007 | Kim et al. | |
| 2008/0088649 | A1 * | 4/2008 | Ikeno et al. | 345/89 |
| 2008/0158131 | A1 | 7/2008 | Park et al. | |

FOREIGN PATENT DOCUMENTS

| | | | |
|---|---|---|---|
| JP | 07-219484 | A | 8/1995 |
| JP | 2004-341101 | A | 12/2004 |
| KR | 0177016 | B1 | 4/1999 |
| KR | 20070083107 | A | 8/2007 |

OTHER PUBLICATIONS

Japanese Notice of Rejection dated Dec. 17, 2013; Patent Application No. JP2010-072472.

* cited by examiner

| | First data driving chip | | Second data driving chip | |
|---|---|---|---|---|
| POL | Even columns | Odd columns | Even columns | Odd columns |
| + | − | No output | No output | + |
| − | No output | − | + | No output |

DATA DRIVING CIRCUIT AND DATA DRIVING METHOD FOR LIQUID CRYSTAL DISPLAY

BACKGROUND

The present invention relates to t a driving circuit and driving method for liquid crystal display.

In the field of liquid crystal display manufacture, large size and high resolution liquid crystal display, refreshing frequency of which is generally above 120 Hz, is used wider and wider.

Data driving chips of the liquid crystal display are located at two ends of a liquid crystal display panel, that is, the data driving chips can comprise a data driving chip located in an upper part of the liquid crystal display panel and a data driving chip located in a lower part of the liquid crystal display panel. In the prior art, a method of performing data driving by a data driving chip in an upper part and a data driving chip in a lower part alternately can be adopted. For example, with respect to an odd frame, a pixel voltage signal can be output to respective pixels in the frame by the data driving chip in the upper part, and with respect to an even frame, a pixel voltage signal can be output to respective pixels in the frame by the data driving chip in the lower part, thus achieving data driving for the liquid crystal display panel. Polarity reversal driving manners formed by the pixel voltage signal can comprise a point reversal driving manner, a column reversal driving manner, etc. With respect to the above-described two driving manners, in the data driving method in the prior art, both of the pixel voltage signal output by the data driving chips in the upper part and the lower part comprise the pixel voltage signal of positive polarity and the pixel voltage signal of negative polarity, therefore, voltage ranges of the pixel voltage signals output by respective data driving chips are all large.

Since the point reversal driving manner can reduce bad phenomena, such as flicker, crosstalk, etc, and obtain very good display quality of pictures, it has very wide application in the field of liquid crystal display. However, when the point reversal driving manner is applied to the large size and high resolution liquid crystal display having high refreshing frequency, since a voltage range of the pixel voltage signals needed to be output by the data driving chip is further increased, a problem that the data driving chip has excessive large power consumption is resulted in. In order to solve the above-described problem of excessive power consumption in the point reversal driving manner, manufacturers generally adopt the column reversal driving manner when manufacturing the large size and high resolution liquid crystal display. A voltage range of pixel voltage signals output by the column reversal driving manner is less than that of the point reversal driving manner, and thus the power consumption of the data driving chip can be reduced to a certain extent, so that existing data driving chip can be applied to the large size and high resolution liquid crystal display. However, in the column reversal driving manner, both of the two bad phenomena of flicker and crosstalk will be relatively evident, which reduce display quality of pictures. In order to eliminate the above-described two bad phenomena to improve display quality of pictures, the manufacturers have to change the design of array substrates.

Therefore, in conclusion, there is no solution in the prior art capable of effectively reducing power consumption of data driving chip in case of employing the existing data driving chip.

SUMMARY

An embodiment of the present invention proposes a driving circuit and driving method for liquid crystal display against the problem in the prior art, which may solve the problem of employing the existing data driving chips and effectively reducing power consumption of the data driving chips.

The driving circuit for liquid crystal display comprises a time sequence controller, a first data driving chip and a second data driving chip connected to the time sequence controller, and a reference voltage buffer connected to the first data driving chip and the second data driving chip respectively.

the time sequence controller is used to decode a received low voltage differential signal to generate a data display signal and a time sequence control signal, divide the data display signal into a first data display signal and a second data display signal according to the time sequence control signal, transmit the first data display signal to the first data driving chip, transmit the second data display signal to the second data driving chip, and transmit the time sequence control signal to the first data driving chip and the second data driving chip respectively.

The reference voltage buffer is used to generate a first reference voltage and a second reference voltage, provide the first reference voltage to the first data driving chip, and provide the second reference voltage to the second data driving chip.

The first data driving chip and the second data driving chip alternately drive a same pixel of a liquid crystal display panel at intervals of a frame; the first data driving chip is used to perform processing on the first data display signal according to the first reference voltage and the time sequence control signal to generate and output a pixel voltage signal of negative polarity to the liquid crystal display panel; the second data driving chip is used to perform processing on the second data display signal according to the second reference voltage and the time sequence control signal to generate and output a pixel voltage signal of positive polarity to the liquid crystal display panel; the pixel voltage signal of negative polarity is lower than a common voltage signal of the liquid crystal display panel, and the pixel voltage signal of positive polarity is higher than the common voltage signal of the liquid crystal display panel.

The embodiment of the present invention also provides a driving method for liquid crystal display, comprising:

step 1: a time sequence controller decoding a received low voltage differential signal to generate a data display signal and a time sequence control signal;

step 2: the time sequence controller dividing the data display signal into a first data display signal and a second data display signal according to the time sequence control signal, transmitting the first data display signal to the first data driving chip, transmitting the second data display signal to the second data driving chip, and transmitting the time sequence control signal to the first data driving chip and the second data driving chip respectively;

step 3: the first data driving chip and the second data driving chip alternately driving a same pixel of a liquid crystal display panel at intervals of a frame, the first data driving chip performing processing on the first data display signal according to a first reference voltage provided by a reference voltage buffer and the time sequence control signal to generate and output a pixel voltage signal of negative polarity to the liquid crystal display panel, the second data driving chip performing processing on the second data display signal according to the second reference voltage provided by the reference voltage buffer and the time sequence control signal to generate and output a pixel voltage signal of positive polarity to the liquid crystal display panel, wherein the pixel voltage signal of negative polarity is lower than a common voltage signal of the liquid crystal display panel, and the pixel voltage signal of positive polarity is higher than the common voltage signal of the liquid crystal display panel.

The two data driving chips in the present invention outputs the pixel voltage signal of positive polarity and the pixel voltage signal of negative polarity to the liquid crystal display panel respectively. As compared with the prior art in which each data driving chip has to output both the pixel voltage signal of positive polarity and the pixel voltage signal of negative polarity, the present invention effectively reduces the voltage ranges of pixel voltage signals output by respective data driving chips, and thus effectively reduces power consumption of the data driving chips in case of employing the existing data driving chips.

The technical solution of the present invention is further described in details through the drawings and embodiments.

DETAILED DESCRIPTION OF THE EMBODIMENTS

Figure 1:
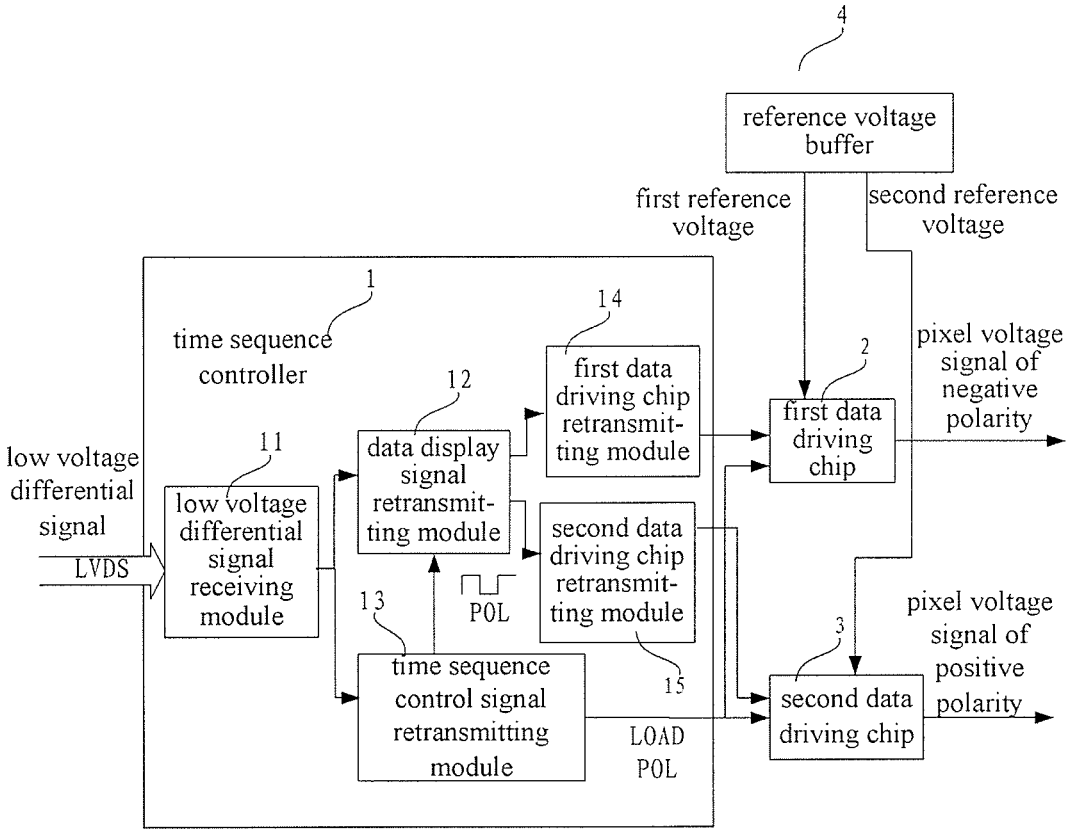
FIG. 1 is a structural schematic diagram of an embodiment of a driving circuit for liquid crystal display of the present invention.

FIG. 1 is a structural schematic diagram of an embodiment of a driving circuit for liquid crystal display of the present invention. As shown in FIG. 1, the driving circuit comprises a time sequence controller 1, a first data driving chip 2 connected to the time sequence controller 1, a second data driving chip 3 connected to the time sequence controller 1, and a reference voltage buffer 4 connected to the first data driving chip 2 and the second data driving chip 3 respectively.

The time sequence controller 1 decodes a received low voltage differential signal to generate a data display signal and a time sequence control signal, and the time sequence controller 1 divides the data display signal into a first data display signal and a second data display signal according to the time sequence control signal, transmits the first data display signal to the first data driving chip 2, transmits the second data display signal to the second data driving chip 3, and transmits the time sequence control signal to the first data driving chip 2 and the second data driving chip 3. The reference voltage buffer 4 can generate a first reference voltage and a second reference voltage, provide the first reference voltage to the first data driving chip 2, and provide the second reference voltage to the second data driving chip 3. The first data driving chip 2 performs processing on the first data display signal according to the first reference voltage and the time sequence control signal to generate and output a pixel voltage signal of negative polarity to the liquid crystal display panel, and the second data driving chip 3 performs processing on the second data display signal according to the second reference voltage and the time sequence control signal to generate and output a pixel voltage signal of positive polarity to the liquid crystal display panel. Among them, the pixel voltage signal of negative polarity is lower than a common voltage signal of the liquid crystal display panel, and the pixel voltage signal of positive polarity is higher than the common voltage signal of the liquid crystal display panel.

In the present embodiment, the time sequence control signal can comprise a polarity reversal signal (in short, a POL signal) and a data reading and outputting signal (in short, a LOAD signal). Then, in particular, the time sequence controller 1 can divide the data display signal into the first data display signal and the second data display signal according to the POL signal.

In the present embodiment, a value of the first reference voltage can be between GAMMA10 and GAMMA18, and a value of the second reference voltage can be between GAMMA1 and GAMMA9. When the value of the first reference voltage is between GAMMA 10 and GAMMA18, then the first data driving chip 2 generates the pixel voltage signal of negative polarity; when the value of the second reference voltage is between GAMMA1 and GAMMA9, the second data driving chip 3 generates the pixel voltage signal of positive polarity.

In particular, the time sequence controller 1 comprises a low voltage differential signal receiving module 11, a data display signal retransmitting module 12 connected to the low voltage differential signal receiving module 11, a time sequence control signal retransmitting module 13 connected to the low voltage differential signal receiving module 11, a first data driving chip retransmitting module 14 connected to the data display signal retransmitting module 12, and a second data driving chip retransmitting module 15 connected to the data display signal retransmitting module 12, wherein the first data driving chip retransmitting module 14 is also connected to the first data driving chip 2, the second data driving chip retransmitting module 15 is also connected to the second data driving chip 3, and the time sequence control signal retransmitting module is also connected to the first data driving chip 2 and the second data driving chip 3 respectively. The low voltage differential signal receiving module 11 receives the low voltage differential signal, decodes the low voltage differential signal to generate the data display signal and the time sequence control signal, transmit the data display signal to the data display signal retransmitting module 12, and transmits the time sequence control signal to the time sequence control signal retransmitting module 13. The time sequence control signal retransmitting module 13 transmits the time sequence control signal to the first data driving chip 2 and the second data driving chip 3 respectively, and transmits the time sequence control signal to the data display signal retransmitting module 12 at the same time. The data display signal retransmitting module 12 divides the data display signal into the first data display signal and the second data display signal according to the time sequence control signal (in particular, the data display signal retransmitting module 12 can divide the data display signal into the first data display signal and the second data display signal according to the polarity reversal signal in the time sequence control signal), transmits the first data display signal to the first data driving chip retransmitting module 14, and transmits the second data display signal to the second data driving chip retransmitting module 15. The first data driving chip retransmitting module 14 retransmits the first data display signal to the first data driving chip 2, and the second data driving chip retransmitting module 15 retransmits the second data display signal to the second data driving chip 3.

Figure 2:
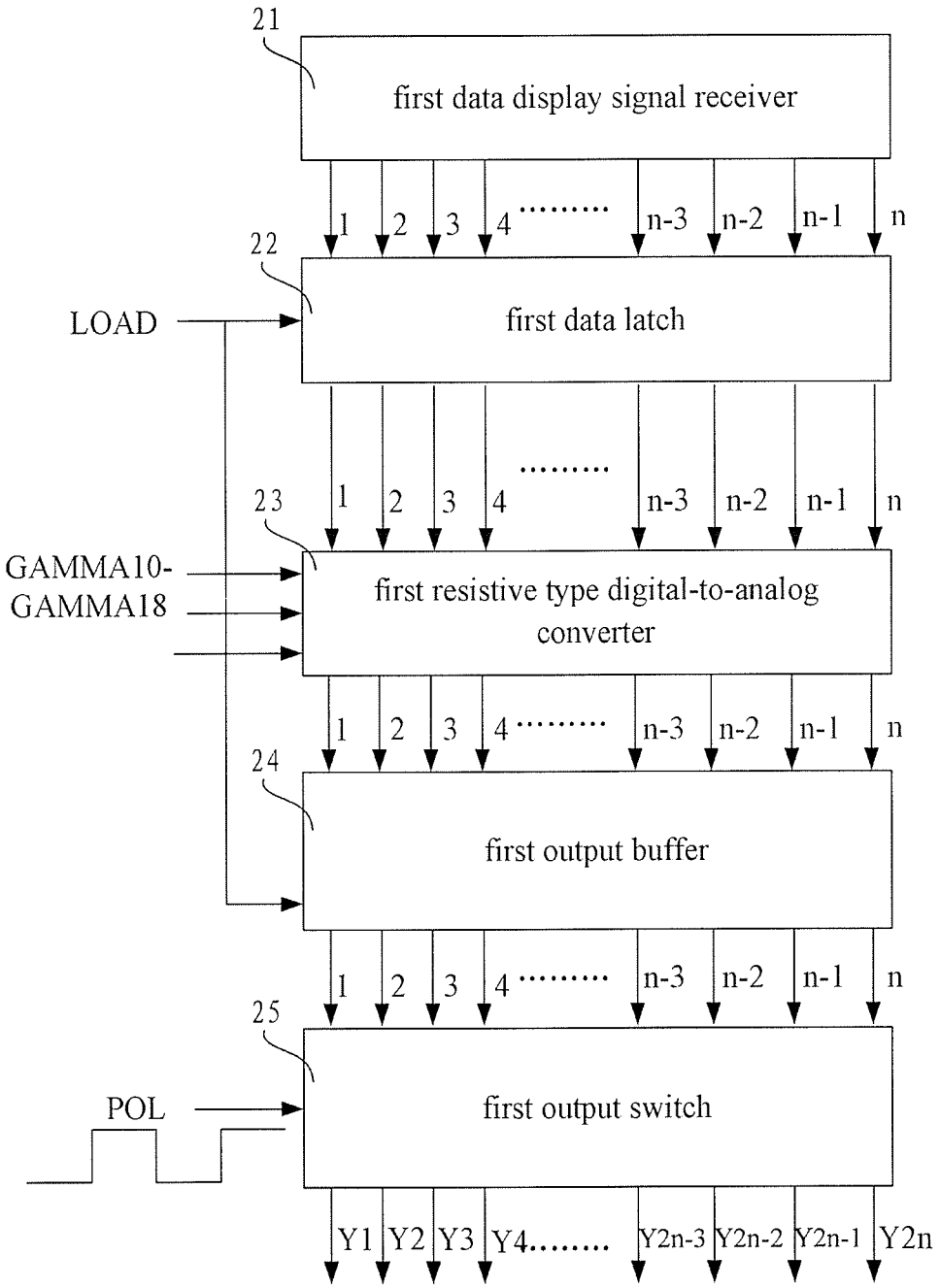
FIG. 2 is a structural schematic diagram of a first data driving chip of the embodiment of the present invention.

In particular, as shown in FIG. 2, FIG. 2 is a structural schematic diagram of the first data driving chip of the present embodiment. The first data driving chip 2 comprises a first data display signal receiver 21, a first data latch 22 connected to the first data display signal receiver 21, a first resistive type digital-to-analog converter 23 connected to the first data latch 22, a first output buffer 24 connected to the first resistive type digital-to-analog converter 23, and a first output switch 25 connected to the first output buffer 24. The first data display signal receiver 21 receives a first data display signal, and transmits the first data display signal to the first data latch 22; the first data latch 22 performs latching processing on the first data display signal according to a received time sequence control signal, and in particular, the first data latch 22 can perform the latching processing on the first data display signal according to a LOAD signal in the received time sequence control signal; the first resistive type digital-to-analog converter 23 performs a digital-to-analog conversion on the first data display signal subjected to the latching processing according to a received first reference voltage to generate a pixel voltage signal of negative polarity; the first output buffer 24 performs a buffering processing on the pixel voltage signal of negative polarity according to the received time sequence control signal, and in particular, the first output buffer 24 can perform the buffering processing on the pixel voltage signal of negative polarity according to the LOAD signal in the received time sequence control signal; the first output switch 25 completes the output of the pixel voltage signal of negative polarity to the liquid crystal display panel according to the time sequence control signal, and in particular, the first output switch 25 can complete the output of the pixel voltage signal of negative polarity to the liquid crystal display panel according to a polarity reversal signal in the time sequence control signal. Among the above, completion of the output of the pixel voltage signal of negative polarity to the liquid crystal display panel according to the polarity reversal signal by the first output switch 25 comprises in particular: when a row of gate line of the liquid crystal display panel is switched on, the first output switch 25 controls data lines of the liquid crystal display panel to be switched on or off according to the polarity reversal signal, and outputs the pixel voltage signal of negative polarity to pixels corresponding to a switched-on data line through the switched-on data line.

Figure 3:
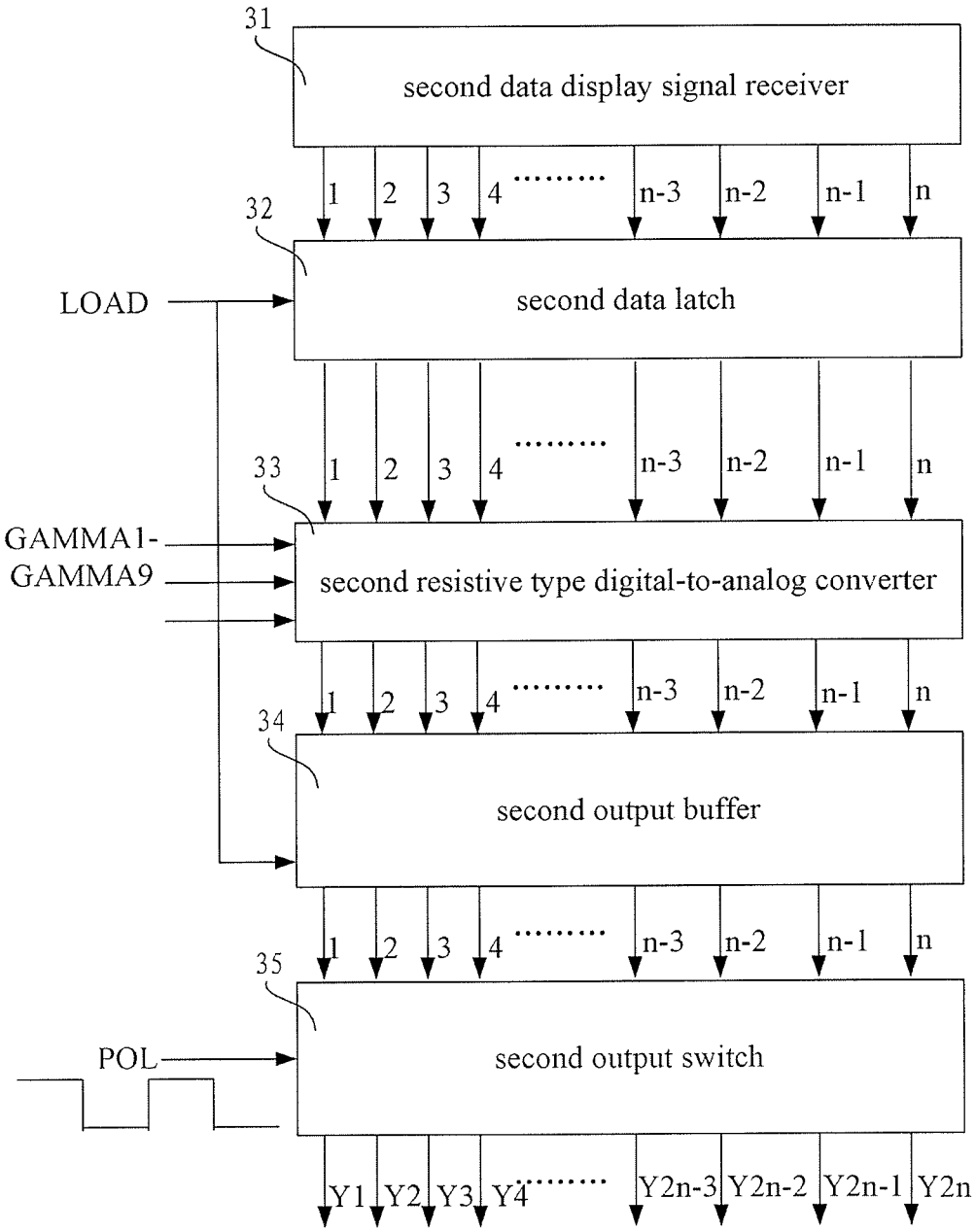
FIG. 3 is a structural schematic diagram of a second data driving chip of the embodiment of the present invention.

In particular, as shown in FIG. 3, FIG. 3 is a structural schematic diagram of the second data driving chip of the present embodiment. The second data driving chip 3 comprises a second data display signal receiver 31, a second data latch 32 connected to the second data display signal receiver 31, a second resistive type digital-to-analog converter 33 connected to the second data latch 32, a second output buffer 34 connected to the second resistive type digital-to-analog converter 33, and a second output switch 35 connected to the second output buffer 34. The second data display signal receiver 31 receives a second data display signal, and transmits the second data display signal to the second data latch 32; the second data latch 32 performs latching processing on the second data display signal according to a received time sequence control signal, and in particular, the second data latch 32 can perform the latching processing on the second data display signal according to a LOAD signal in the received time sequence control signal; the second resistive type digital-to-analog converter 33 performs a digital-to-analog conversion on the second data display signal according to the second reference voltage to generate a pixel voltage signal of positive polarity; the second output buffer 34 performs a buffering processing on the pixel voltage signal of positive polarity according to the time sequence control signal, and in particular, the second output buffer 34 can perform the buffering processing on the pixel voltage signal of positive polarity according to the LOAD signal in the time sequence control signal; the second output switch 35 completes the output of the pixel voltage signal of positive polarity to the liquid crystal display panel according to the time sequence control signal, and in particular, the second output switch 35 can complete the output of the pixel voltage signal of positive polarity to the liquid crystal display panel according to a polarity reversal signal in the time sequence control signal. Among the above, completion of the output of the pixel voltage signal of positive polarity to the liquid crystal display panel according to the polarity reversal signal by the second output switch 35 comprises in particular: when a row of gate line of the liquid crystal display panel is switched on, the second output switch 35 controls data lines of the liquid crystal display panel to be switched on or off according to the polarity reversal signal, and outputs the pixel voltage signal of positive polarity to pixels corresponding to a switched-on data line through the switched-on data line.

The driving circuit for liquid crystal display in the present embodiment can make a polarity reversal mode formed by the liquid crystal display be point reversal, column reversal, row reversal, and various other reversal driving manners.

Figure 4:
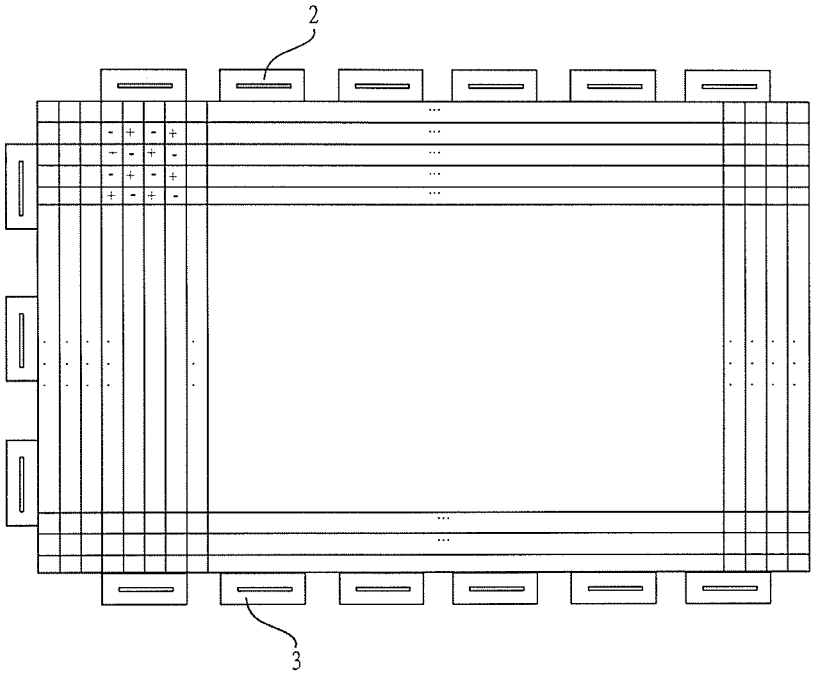
FIG. 4 is a schematic diagram showing the polarity of respective pixel voltage signals in odd frames in a point reversal driving manner of the embodiment of the present invention.
Figure 5:
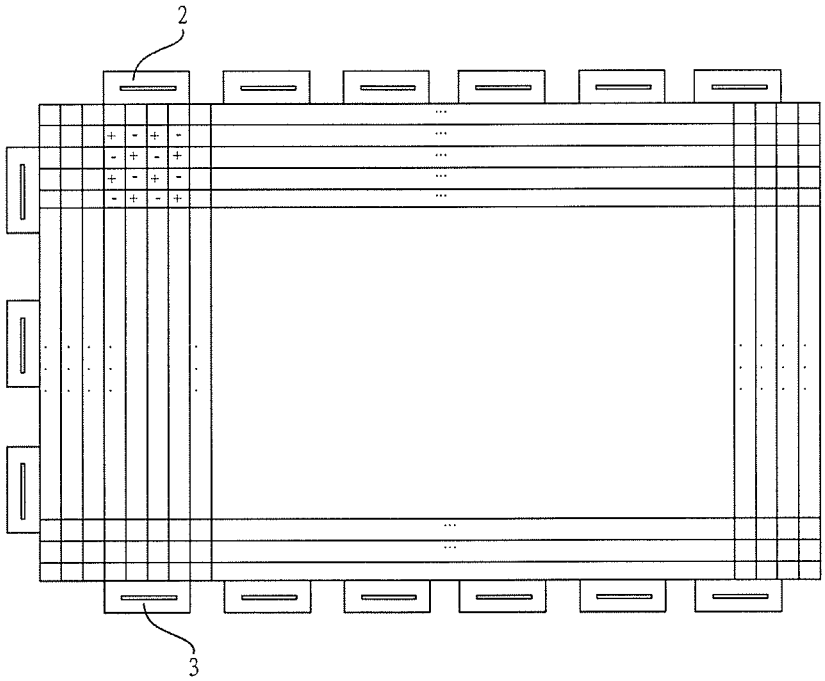
FIG. 5 is a schematic diagram showing the polarity of respective pixel voltage signals in even frames in the point reversal driving manner of the embodiment of the present invention.

Hereinafter, driving process of the driving circuit for liquid crystal display is explained in details by taking the point reversal driving manner as an example. In picture display process of liquid crystal display, pixel voltage signals of respective pixels in two consecutive frames have reversal polarities. FIG. 4 is a schematic diagram showing polarities of respective pixel voltage signals in odd frames in the point reversal driving manner of the present embodiment, and FIG. 5 is a schematic diagram showing polarities of respective pixel voltage signals in even frames in the point reversal driving manner of the present embodiment. As shown in FIGS. 4 and 5, the polarity reversal mode formed by the liquid crystal display panel in FIGS. 4 and 5 is the point reversal driving manner.

At this moment, the processing of dividing the data display signal into the first data display signal and the second data display signal according to the polarity reversal signal, transmitting the first data display signal to the first data driving chip retransmitting module 14, and transmitting the second data display signal to the second data driving chip retransmitting module 15 by the data display signal retransmitting module 12 in the time sequence controller 1 particularly comprises: when the polarity reversal signal received by the data display signal retransmitting module 12 is a low level signal, the data display signal retransmitting module 12 sequentially transmits data display signals corresponding to a row of pixels in the liquid crystal display panel to the first data driving chip retransmitting module 14 and the second data driving chip retransmitting module 15 alternately, wherein the signal transmitted to the first data driving chip retransmitting module 14 is the first data display signal and the signal transmitted to the second data driving chip retransmitting module 15 is the second data display signal; when the polarity reversal signal received by the data display signal retransmitting module 12 is a high level signal, the data display signal retransmitting module 12 sequentially and alternately transmits data display signals corresponding to a row of pixels in the liquid crystal display panel to the second data driving chip retransmitting module 15 and the first data driving chip retransmitting module 14, wherein the signal transmitted to the first data driving chip retransmitting module 14 is the first data display signal and the signal transmitted to the second data driving chip retransmitting module 15 is the second data display signal. In order to make the polarity reversal mode formed by the liquid crystal display panel be the point reversal driving manner, polarity reversal signals corresponding to data display signals of pixels in adjacent rows of the liquid crystal display panel are different. For example, if the polarity reversal signal corresponding to a data display signal of a row of pixels is a low level signal, then the polarity reversal signal corresponding to a data display signal of pixels in an adjacent row of said row is a high level signal. With respect to an odd frame in FIG. 4, the polarity reversal signal corresponding to a data display signal of a first row of pixels in this frame can be a low level signal. With respect to an even frame in FIG. 5, the polarity reversal signal corresponding to a data display signal of a first row of pixels in this frame can be a high level signal.

Figures 6, 7:
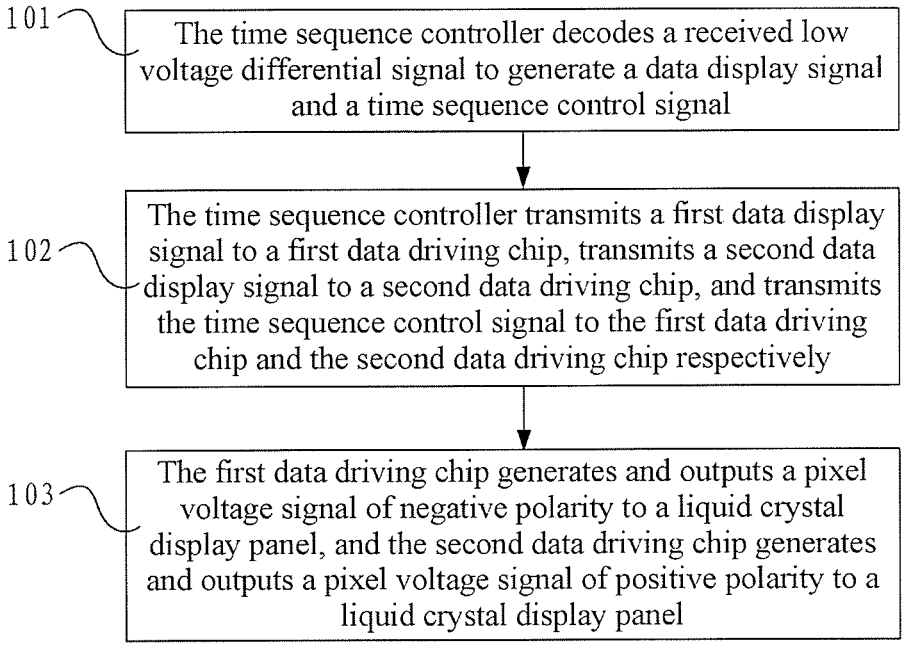
FIG. 6 is a schematic diagram showing the output of pixel voltage signals in the point reversal driving manner of the embodiment of the present invention.
FIG. 7 is a flow diagram of an embodiment of a driving method for liquid crystal display of the embodiment of the present invention.

After the first data driving chip 2 receives the first data display signal transmitted by the first data driving chip retransmitting module 14, the first resistive type digital-to-analog converter 23 in the first data driving chip 2 performs a digital-to-analog conversion on the first data display signal according to the first reference voltage having a value between GAMMA10 and GAMMA18 to generate the pixel voltage signal of negative polarity. After the second data driving chip 3 receives the second data display signal transmitted by the second data driving chip retransmitting module 15, the second resistive type digital-to-analog converter 33 in the second data driving chip 3 performs a digital-to-analog conversion on the second data display signal according to the second reference voltage having a value between GAMMA1 and GAMMA9 to generate the pixel voltage signal of positive polarity. Then, the first output switch 25 in the first data driving chip 2 completes the output of the pixel voltage signal of negative polarity to the liquid crystal display panel according to the polarity reversal signal, and the second output switch 35 in the second data driving chip 3 completes the output of the pixel voltage signal of positive polarity to the liquid crystal display panel according to the polarity reversal signal, as shown in FIG. 6. FIG. 6 is a schematic diagram showing the output of pixel voltage signals in the point reversal driving manner of the present embodiment. When a row of gate line of the liquid crystal display panel is switched on, if the polarity reversal signal is a low level signal, the first output switch 25 in the first data driving chip 2 controls odd columns of data lines of the liquid crystal display panel to be switched on to the first output switch 25 and controls the even columns of data lines to be switched off to the first output switch 25, and then the first output switch 25 in the first data driving chip 2 outputs the pixel voltage signal of negative polarity to pixels corresponding to switched-on odd columns of data lines through the switched-on odd columns of data lines; at the same time, the second output switch 35 in the second data driving chip 3 controls even columns of data lines of the liquid crystal display panel to be switched on to the second output switch 35 and controls the odd columns of data lines to be switched off to the second output switch 35, and then the second output switch 35 in the second data driving chip 3 outputs the pixel voltage signal of positive polarity to pixels corresponding to switched-on even columns of data lines through the switched-on even columns of data lines. When a row of gate line of the liquid crystal display panel is switched on, if the polarity reversal signal is a high level signal, the first output switch 25 in the first data driving chip 2 controls even columns of data lines of the liquid crystal display panel to be switched on to the first output switch 25 and controls the odd columns of data lines to be switched off to the first output switch 25, and then the first output switch 25 in the first data driving chip 2 outputs the pixel voltage signal of negative polarity to pixels corresponding to switched-on even columns of data lines through the switched-on even columns of data lines; at the same time, the second output switch 35 in the second data driving chip 3 controls odd columns of data lines of the liquid crystal display panel to be switched on to the second output switch 35 and controls the even columns of data lines to be switched off to the second output switch 35, and then the second output switch 35 in the second data driving chip 3 outputs the pixel voltage signal of positive polarity to pixels corresponding to switched-on odd columns of data lines through the switched-on odd columns of data lines. For example, with respect to a first row of pixels of odd frames in FIG. 4, the first data driving chip 2 outputs the pixel voltage signal of negative polarity to odd columns of pixels through odd columns of data lines, and the second data driving chip 3 outputs pixel voltage signals of positive polarity to even columns of pixels through even columns of data lines; with respect to a first row of pixels of even frames in FIG. 5, the first data driving chip 2 outputs pixel voltage signals of negative polarity to even columns of pixels through even columns of data lines, and the second data driving chip 3 outputs pixel voltage signals of positive polarity to odd columns of pixels through odd columns of data lines. Thus, the polarity reversal mode formed by respective pixel voltage signals on the liquid crystal display panel is the point reversal driving manner.

In the present embodiment, the two data driving chips output the pixel voltage signal of positive polarity and the pixel voltage signal of negative polarity to the liquid crystal display panel respectively. As compared with the prior art in which each data driving chip has to output a pixel voltage signal of positive polarity and a pixel voltage signal of negative polarity, the present embodiment effectively reduces voltage ranges of pixel voltage signals output by respective data driving chips, and thus effectively reduces power consumption of data driving chips; because of effectively reducing power consumption of the data driving chips, the point reversal driving manner in the present embodiment can be better applied to large size and high resolution liquid crystal display, thus obtaining better display quality of pictures. The time sequence controller divides the data display signal into two parts and outputs them to two data driving chips respectively, which reduces the refreshing frequency, and therefore the Electromagnetic Interference (in short, EMI) is reduced to a certain extent. As compared with the prior art, each data driving chip only needs half of the original reference voltage range, therefore, a simplification processing can be performed on internal circuits of the data driving chip, and the simplified data driving chip can not only pay attention to display quality of pictures, but also save power consumption.

FIG. 7 is a flow diagram of an embodiment of a driving method for liquid crystal display of the present embodiment, and the driving method of the present embodiment can be based on the driving circuit in FIG. 1. As shown in FIG. 7, the method comprises:

step 101: a time sequence controller decodes a received low voltage differential signal to generate a data display signal and a time sequence control signal, in the present embodiment, the time sequence control signal can comprise a polarity reversal signal (in short, a POL signal) and a data reading and outputting signal (in short, a LOAD signal);

step 102: the time sequence controller divides the data display signal into a first data display signal and a second data display signal according to the time sequence control signal, transmits the first data display signal to the first data driving chip, transmits the second data display signal to the second data driving chip, and transmits the time sequence control signal to the first data driving chip and the second data driving chip respectively, Particularly, the time sequence controller divides the data display signal into a first data display signal and a second data display signal according to the POL signal; and step 103: the first data driving chip and the second data driving chip alternately drive a same pixel of a liquid crystal display panel at intervals of a frame, the first data driving chip performs processing on the first data display signal according to a first reference voltage provided by a reference voltage buffer and the time sequence control signal to generate and output a pixel voltage signal of negative polarity to the liquid crystal display panel, the second data driving chip performs processing on the second data display signal according to the second reference voltage provided by the reference voltage buffer and the time sequence control signal to generate and output a pixel voltage signal of positive polarity to the liquid crystal display panel, wherein the pixel voltage signal of negative polarity is lower than a common voltage signal of the liquid crystal display panel, and the pixel voltage signal of positive polarity is higher than the common voltage signal of the liquid crystal display panel.

The step 103 comprises in particular: the first data driving chip performs a digital-to-analog conversion on the first data display signal according to the first reference voltage to generate the pixel voltage signal of negative polarity, and the first data driving chip completes the output of the pixel voltage signal of negative polarity to the liquid crystal display panel according to the time sequence control signal; the second data driving chip performs a digital-to-analog conversion on the second data display signal according to the second reference voltage to generate the pixel voltage signal of positive polarity, and the second data driving chip completes the output of the pixel voltage signal of positive polarity to the liquid crystal display panel according to the time sequence control signal. Among the above, completing by the first data driving chip the output of the pixel voltage signal of negative polarity to the liquid crystal display panel according to the time sequence control signal comprises in particular: when a row of gate line of the liquid crystal display panel is switched on, the first data driving chip controls data lines of the liquid crystal display panel to be switched on or off to the first data driving chip according to a polarity reversal signal, and outputs the pixel voltage signal of negative polarity to pixels corresponding to a switched-on data line through the switched-on data line; completing by the second data driving chip the output of the pixel voltage signal of positive polarity to the liquid crystal display panel according to the time sequence control signal comprises in particular: when a row of gate line of the liquid crystal display panel is switched on, the second data driving chip controls data lines of the liquid crystal display panel to be switched on or off to the second data driving chip according to the polarity reversal signal, and outputs the pixel voltage signal of positive polarity to pixels corresponding to a switched-on data line through the switched-on data line. Since the first data driving chip and the second data driving chip alternately drive a same pixel of the liquid crystal display panel at intervals of a frame, when a data line is switched on to the first data driving chip, this data line is switched off to the second data driving chip.

Further, prior to that the first data driving chip performs the digital-to-analog conversion on the first data display signal according to the first reference voltage to generate the pixel voltage signal of negative polarity, the method can also comprise: the first data driving chip performs latching processing on the received first data display signal according to a LOAD signal; prior to that the first data driving chip completes the output of the pixel voltage signal of negative polarity to the liquid crystal display panel according to the time sequence control signal, the method can also comprises: the first data driving chip performs buffering processing on the pixel voltage signal of negative polarity according to the LOAD signal. Prior to that the second data driving chip performs the digital-to-analog conversion on the second data display signal according to the second reference voltage to generate the pixel voltage signal of positive polarity, the method can also comprises: the second data driving chip performs latching processing on the received second data display signal according to the LOAD signal; prior to that the second data driving chip completes the output of the pixel voltage signal of positive polarity to the liquid crystal display panel according to the time sequence control signal, the method can also comprises: the second data driving chip performs buffering processing on the pixel voltage signal of positive polarity according to the LOAD signal.

The driving method for liquid crystal display in the present embodiment can make a polarity reversal mode formed by the liquid crystal display be a point reversal driving manner, a column reversal driving manner, or a row reversal driving manner.

The two data driving chips in the present embodiment output the pixel voltage signal of positive polarity and the pixel voltage signal of negative polarity to the liquid crystal display panel respectively. As compared with the prior art in which each data driving chip has to output a pixel voltage signal of positive polarity and a pixel voltage signal of negative polarity, the present embodiment effectively reduces voltage ranges of pixel voltage signals output by respective data driving chips, and thus effectively reduces power consumption of data driving chips; because of effectively reducing power consumption of the data driving chips, the point reversal driving manner in the present embodiment can be better applied to large size and high resolution liquid crystal display, thus obtaining better display quality of pictures. The time sequence controller divides the data display signal into two parts and outputs them to two data driving chips respectively, which reduces the refreshing frequency, and therefore the EMI is reduced to a certain extent. As compared with the prior art, each data driving chip only needs half of the original reference voltage range, therefore, a simplification processing can be performed on internal circuits of the data driving chip, and the simplified data driving chip can not only pay attention to display quality of pictures, but also save power consumption.

Finally, it must be explained that the embodiments above are only used to explain but not limit the technical solution of the present invention. Although the present invention has been explained in details with reference to preferred embodiments, it is understood by those of ordinary skills in the art that modifications or equivalent replacements can still be made to the technical solution of the present invention, and these modifications or equivalent replacements also cannot make the modified technical solution depart from spirits and scopes of the technical solution of the present invention.

What is claimed is:

1. A driving circuit for liquid crystal display, comprising a time sequence controller, a first data driving chip and a second data driving chip connected to the time sequence controller, and a reference voltage buffer connected to the first data driving chip and the second data driving chip respectively, wherein the time sequence controller is used to decode a received low voltage differential signal to generate a data display signal and a time sequence control signal, divide the data display signal into a first data display signal and a second data display signal according to the time sequence control signal, transmit the first data display signal to the first data driving chip, transmit the second data display signal to the second data driving chip, and transmit the time sequence control signal to the first data driving chip and the second data driving chip respectively;

the reference voltage buffer is used to generate a first reference voltage and a second reference voltage, provide the first reference voltage to the first data driving chip, and provide the second reference voltage to the second data driving chip; and the first data driving chip and the second data driving chip alternately drive a same pixel of a liquid crystal display panel at intervals of a frame; the first data driving chip is used to perform processing on the first data display signal according to the first reference voltage and the time sequence control signal to generate and output a pixel voltage signal of negative polarity to the liquid crystal display panel; the second data driving chip is used to perform processing on the second data display signal according to the second reference voltage and the time sequence control signal to generate and output a pixel voltage signal of positive polarity to the liquid crystal display panel; the pixel voltage signal of negative polarity is lower than a common voltage signal of the liquid crystal display panel, and the pixel voltage signal of positive polarity is higher than the common voltage signal of the liquid crystal display panel, and wherein the time sequence controller comprises a low voltage differential signal receiving module, a data display signal retransmitting module and a time sequence control signal retransmitting module connected to the low voltage differential signal receiving module, a first data driving chip retransmitting module and a second data driving chip retransmitting module connected to the data display signal retransmitting module, the low voltage differential signal receiving module is used to receive the low voltage differential signal, decode the low voltage differential signal to generate the data display signal and the time sequence control signal, transmit the data display signal to the data display signal retransmitting module, and transmit the time sequence control signal to the time sequence control signal retransmitting module;

the time sequence control signal retransmitting module is used to transmit the time sequence control signal to the data display signal retransmitting module, and retransmit the time sequence control signal to the first data driving chip and the second data driving chip at the same time;

the data display signal retransmitting module is used to divide the data display signal into the first data display signal and the second data display signal according to the time sequence control signal, transmit the first data display signal to the first data driving chip retransmitting module, and transmit the second data display signal to the second data driving chip retransmitting module;

the first data driving chip retransmitting module is used to retransmit the first data display signal to the first data driving chip; and the second data driving chip retransmitting module is used to retransmit the second data display signal to the second data driving chip.

2. The circuit according to claim 1, wherein the first data driving chip comprises a first data display signal receiver, a first data latch connected to the first data display signal receiver, a first resistive type digital-to-analog converter connected to the first data latch, a first output buffer connected to the first resistive type digital-to-analog converter, and a first output switch connected to the first output buffer; and the second data driving chip comprises a second data display signal receiver, a second data latch connected to the second data display signal receiver, a second resistive type digital-to-analog converter connected to the second data latch, a second output buffer connected to the second resistive type digital-to-analog converter, and a second output switch connected to the second output buffer.

3. The circuit according to claim 2, wherein a polarity reversal mode formed by the liquid crystal display panel is a point reversal driving manner, a column reversal driving manner, or a row reversal driving manner.

4. A driving method for liquid crystal display, comprising:

step 1: a time sequence controller decoding a received low voltage differential signal to generate a data display signal and a time sequence control signal;

step 2: the time sequence controller dividing the data display signal into a first data display signal and a second data display signal according to the time sequence control signal, transmitting the first data display signal to the first data driving chip, transmitting the second data display signal to the second data driving chip, and transmitting the time sequence control signal to the first data driving chip and the second data driving chip respectively;

step 3: the first data driving chip and the second data driving chip alternately driving a same pixel of a liquid crystal display panel at intervals of a frame, the first data driving chip performing processing on the first data display signal according to a first reference voltage provided by a reference voltage buffer and the time sequence control signal to generate and output a pixel voltage signal of negative polarity to the liquid crystal display panel, the second data driving chip performing processing on the second data display signal according to the second reference voltage provided by the reference voltage buffer and the time sequence control signal to generate and output a pixel voltage signal of positive polarity to the liquid crystal display panel, wherein the pixel voltage signal of negative polarity is lower than a common voltage signal of the liquid crystal display panel, and the pixel voltage signal of positive polarity is higher than the common voltage signal of the liquid crystal display panel;

wherein the time sequence controller comprises a low voltage differential signal receiving module, a data display signal retransmitting module and a time sequence control signal retransmitting module connected to the low voltage differential signal receiving module, a first data driving chip retransmitting module and a second data driving chip retransmitting module connected to the data display signal retransmitting module;

the low voltage differential signal receiving module is used to receive the low voltage differential signal, decode the low voltage differential signal to generate the data display signal and the time sequence control signal, transmit the data display signal to the data display signal retransmitting module and transmit the time sequence control signal to the time sequence control signal retransmitting module;

the time sequence control signal retransmitting module is used to transmit the time sequence control signal to the data display signal retransmitting module, and retransmit the time sequence control signal to the first data driving chip and the second data driving chip at the same time;

the data display signal retransmitting module is used to divide the data display signal into the first data display signal and the second data display signal according to the time sequence control signal, transmit the first data display signal to the first data driving chip retransmitting module and transmit the second data display signal to the second data driving chip retransmitting module;

the first data driving chip retransmitting module is used to retransmit the first data display signal to the first data driving chip;

and the second data driving chip retransmitting module is used to retransmit the second data display signal to the second data driving chip.

5. The method according to claim 4, wherein the step 3 comprises:

the first data driving chip performs a digital-to-analog conversion on the first data display signal according to the first reference voltage to generate the pixel voltage signal of negative polarity, and the first data driving chip completes output of the pixel voltage signal of negative polarity to the liquid crystal display panel according to the time sequence control signal; the second data driving chip performs a digital-to-analog conversion on the second data display signal according to the second reference voltage to generate the pixel voltage signal of positive polarity, and the second data driving chip completes output of the pixel voltage signal of positive polarity to the liquid crystal display panel according to the time sequence control signal.

6. The method according to claim 5, wherein the time sequence control signal comprises a polarity reversal signal; completing by the first data driving chip the output of the pixel voltage signal of negative polarity to the liquid crystal display panel according to the time sequence control signal comprises: when a row of gate line of the liquid crystal display panel is switched on, the first data driving chip controls data lines of the liquid crystal display panel to be switched on or off to the first data driving chip according to the polarity reversal signal, and outputs the pixel voltage signal of negative polarity to pixels corresponding to a switched-on data line through the switched-on data line; completing by the second data driving chip the output of the pixel voltage signal of positive polarity to the liquid crystal display panel according to the time sequence control signal comprises: when a row of gate line of the liquid crystal display panel is switched on, the second data driving chip controls data lines of the liquid crystal display panel to be switched on or off to the second data driving chip according to the polarity reversal signal, and outputs the pixel voltage signal of positive polarity to pixels corresponding to a switched-on data line through the switched-on data line.

7. The method according to claim 6, wherein a polarity reversal mode formed by the liquid crystal display panel is a point reversal driving manner, a column reversal driving manner, or a row reversal driving manner.

8. The method according to claim 5, wherein a polarity reversal mode formed by the liquid crystal display panel is a point reversal driving manner, a column reversal driving manner, or a row reversal driving manner.

9. The method according to claim 4, wherein a polarity reversal mode formed by the liquid crystal display panel is a point reversal driving manner, a column reversal driving manner, or a row reversal driving manner.

* * * * *